US010565958B2

(12) United States Patent
An et al.

(10) Patent No.: US 10,565,958 B2
(45) Date of Patent: Feb. 18, 2020

(54) IMAGE PROCESSING DEVICE AND DISPLAY DEVICE HAVING THE SAME

(71) Applicant: SAMSUNG DISPLAY CO., LTD., Yongin-si, Gyeonggi-do (KR)

(72) Inventors: Bo-Young An, Yongin-si (KR); Ji-Yun Son, Yongin-si (KR); Ho-Suk Maeng, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 689 days.

(21) Appl. No.: 15/141,016

(22) Filed: Apr. 28, 2016

(65) Prior Publication Data

US 2017/0039997 A1 Feb. 9, 2017

(30) Foreign Application Priority Data

Aug. 5, 2015 (KR) ..... 10-2015-0110573

(51) Int. Cl.
*G09G 5/10* (2006.01)

(52) U.S. Cl.
CPC ..... *G09G 5/10* (2013.01); *G09G 2320/0626* (2013.01); *G09G 2330/00* (2013.01); *G09G 2360/16* (2013.01)

(58) Field of Classification Search
None
See application file for complete search history.

(56) References Cited

U.S. PATENT DOCUMENTS

2013/0127923 A1* 5/2013 An ..... G09G 5/10 345/690
2013/0249955 A1* 9/2013 Kim ..... G09G 3/3233 345/690

FOREIGN PATENT DOCUMENTS

KR 10-2011-0055259 A 5/2011

* cited by examiner

*Primary Examiner* — Nichols J Lee
(74) *Attorney, Agent, or Firm* — Lewis Roca Rothgerber Christie LLP

(57) ABSTRACT

An image processing device includes a current limiter and a brightness controller. The current limiter calculates compensating data based on an on-pixel ratio of an image signal and calculates a compensation brightness data of the image signal based on the compensating data. The compensating data decreases the driving current of the image signal. The brightness controller selects one of a plurality of gamma sets and one of a plurality of dimming values based on the compensation brightness data.

17 Claims, 8 Drawing Sheets

IMAGE PROCESSING DEVICE AND DISPLAY DEVICE HAVING THE SAME

CROSS-REFERENCE TO RELATED APPLICATION

Korean Patent Application No. 10-2015-0110573, filed on Aug. 5, 2015, and entitled, "Image Processing Device and Display Device Having the Same," is incorporated by reference herein in its entirety.

BACKGROUND

1. Field

One or more embodiments described herein relate to an image processing device and a display device having an image processing device.

2. Description of the Related Art

A variety of flat panel displays have been developed. These displayer are widely in electronic devices because they are thin and lightweight compared to cathode-ray tube displays. Examples of flat panel displays include liquid crystal displays, field emission displays, plasma display panels, and organic light emitting displays (OLEDs). OLED displays have a wide viewing angle, fast response speed, low power consumption, and are thin. As the size and resolution of flat panel displays increases, power consumption is expected to increase.

SUMMARY

In accordance with one or more embodiments, an image processing device includes a current limiter to calculate compensating data based on an on-pixel ratio of an image signal and to calculate a compensation brightness data of the image signal based on the compensating data, the compensating data to decrease a driving current of the image signal; and a brightness controller to select one of a plurality of gamma sets and one of a plurality of dimming values based on the compensation brightness data.

The current limiter may include an on-pixel ratio calculator to calculate the on-pixel ratio of the image signal; a compensating data calculator to calculate the compensating data corresponding to the on-pixel ratio; and a compensation brightness calculator to calculate the compensation brightness data based on the compensating data. The compensating data calculator may calculate the compensating data when the on-pixel ratio is higher than a predetermined reference grayscale data level.

The compensating data calculator may calculate the compensating data based on the reference grayscale data level, a maximum grayscale data level, and a predetermined maximum compensating data. The compensating brightness calculator may calculate the compensating brightness data based on the compensating data and an input brightness. The on-pixel ratio calculator may calculate the on-pixel ratio of the image signal based on a red on-pixel ratio that is the on-pixel ratio of a red image signal in the image signal, a green on-pixel ratio that is the on-pixel ratio of a green image signal in the image signal, and a blue on-pixel ratio that is the on-pixel ratio of a blue image signal in the image signal. The brightness controller may select one of the gamma sets based on the compensating brightness data. The brightness controller may select one of the dimming values based on the compensating brightness data.

In accordance with one or more other embodiments, a display device includes a display panel including a plurality of pixels; an image processor to calculate compensating data based on an on-pixel ratio of an image signal when the image signal is displayed on the display panel and to control a brightness of the image signal based on the compensating data, the compensating data to decrease a driving current of the display panel; a scan driver to provide a scan signal to the pixels; a data driver to provide a data signal to the pixels; an emission controller to provide an emission control signal to the pixels; and a controller to generate control signals to control the image processor, the scan driver, the data driver, and the emission controller.

The image processor may include a current limiter to calculate the compensating data based on the on-pixel ratio and to calculate a compensation brightness data of the image signal based on the compensating data; and a brightness controller to select one of a plurality of gamma sets and one of a plurality of dimming values based on the compensation brightness data. The data driver may generate the data signal corresponding to a data voltage based on the image signal and the selected gamma set. The emission controller may generate the emission control signal based on the selected dimming value.

The current limiter may include an on-pixel ratio calculator to calculate the on-pixel ratio of the image signal; a compensating data calculator to calculate the compensating data corresponding to the on-pixel ratio; and a compensation brightness calculator to calculate the compensating brightness data based on the compensating data.

The compensating data calculator may calculate the compensating data when the on-pixel ratio is higher than a predetermined reference grayscale data level. The compensating data calculator may calculate the compensating data based on the reference grayscale data level, a maximum grayscale data level, and a predetermined maximum compensating data. The compensation brightness calculator may calculate the compensation brightness data based on the compensating data and an input brightness.

The on-pixel ratio calculator may calculate the on-pixel ratio of the image signal based on a red on-pixel ratio of a red image signal in the image signal, a green on-pixel ratio of a green image signal in the image signal, and a blue on-pixel ratio of a blue image signal in the image signal. The brightness controller may select one of the gamma sets based on the compensation brightness data. The brightness controller may select one of the dimming values based on the compensation brightness data. The image processor may be coupled or located in the data driver.

BRIEF DESCRIPTION OF THE DRAWINGS

Features will become apparent to those of skill in the art by describing in detail exemplary embodiments with reference to the attached drawings in which.

DETAILED DESCRIPTION

Figure 1:
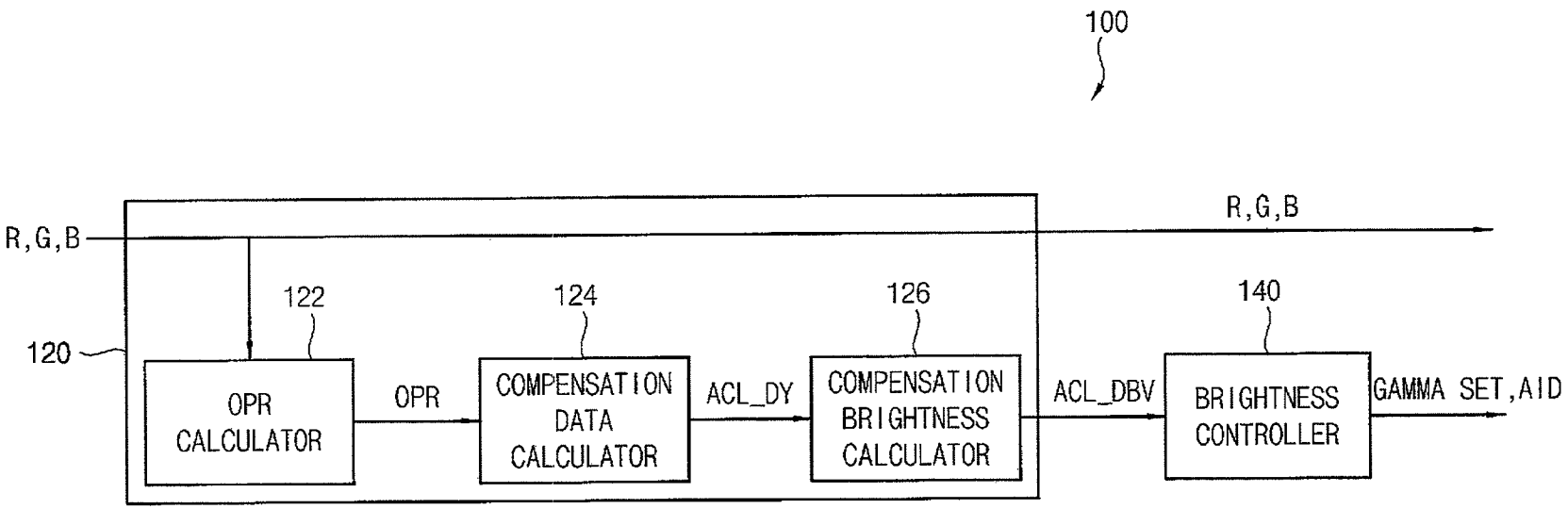
FIG. 1 illustrates an embodiment of an image processing device.

Example embodiments will now be described more fully hereinafter with reference to the accompanying drawings; however, they may be embodied in different forms and should not be construed as limited to the embodiments set forth herein. Rather, these embodiments are provided so that this disclosure will be thorough and complete, and will fully convey exemplary implementations to those skilled in the art. The embodiments may be combined to form additional embodiments.

In the drawing figures, the dimensions of layers and regions may be exaggerated for clarity of illustration. It will also be understood that when a layer or element is referred to as being "on" another layer or substrate, it can be directly on the other layer or substrate, or intervening layers may also be present. Further, it will be understood that when a layer is referred to as being "under" another layer, it can be directly under, and one or more intervening layers may also be present. In addition, it will also be understood that when a layer is referred to as being "between" two layers, it can be the only layer between the two layers, or one or more intervening layers may also be present. Like reference numerals refer to like elements throughout.

When an element is referred to as being "connected" or "coupled" to another element, it can be directly connected or coupled to the another element or be indirectly connected or coupled to the another element with one or more intervening elements interposed therebetween. In addition, when an element is referred to as "including" a component, this indicates that the element may further include another component instead of excluding another component unless there is different disclosure.

Figure 2:
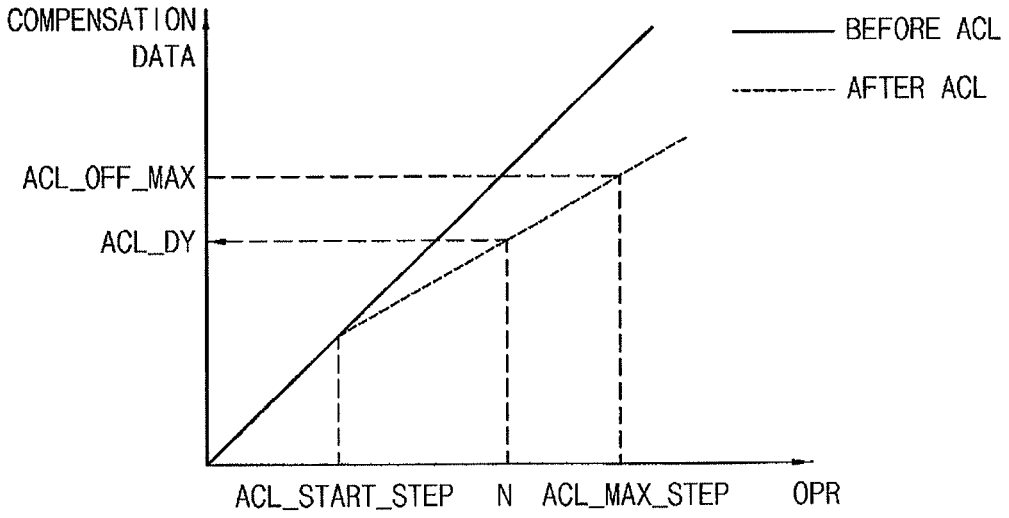
FIG. 2 illustrates an example operation of a compensating data calculator.
Figure 3:
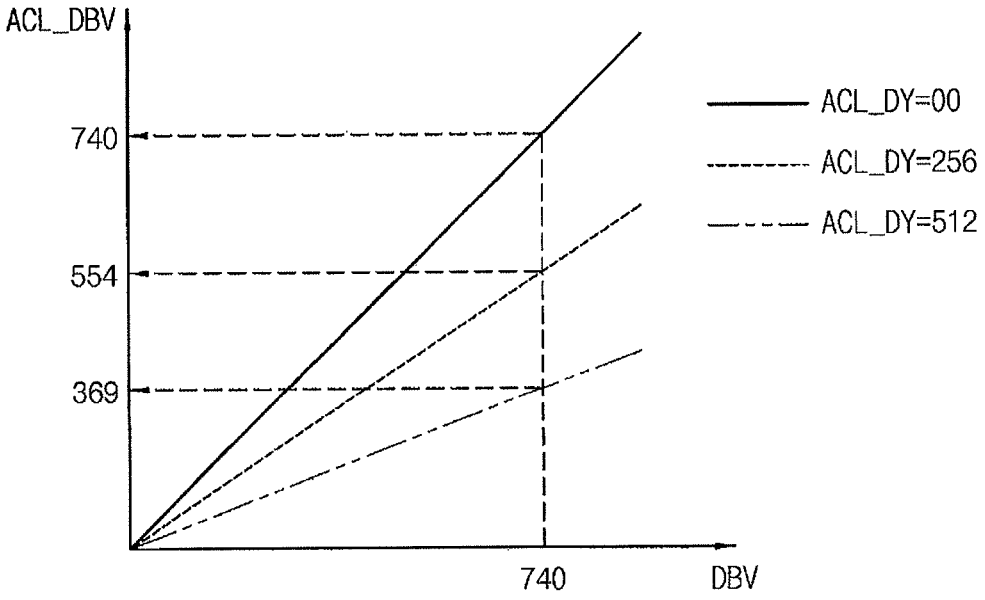
FIG. 3 illustrates an example operation of a compensation brightness calculator.

FIG. 1 illustrates an embodiment of an image processing device 100. FIG. 2 is a graph of showing operation of a compensating data calculator in the image processing device 100 of FIG. 1. FIG. 3 is a graph of showing operation of a compensation brightness calculator in the image processing device of FIG. 1.

Referring to FIG. 1, an image processing device 100 includes a current limiter 120 and a brightness controller 140. The current limiter 120 calculates compensating data ACL_DY that decreases a driving current of an image signal R, G, B based on an on-pixel ratio OPR of the image signal R, G, B, and calculates compensation brightness data ACL_DBV of the image signal R, G, B based on the compensating data ACL_DY.

The current limiter 120 includes an on-pixel ratio calculator 122, a compensating data calculator 124, and a compensating brightness calculator 126. The on-pixel ratio calculator 122 calculates the on-pixel ratio OPR of the image signal R, G, B, which includes a red image signal R to display red light, a green image signal G to display green light, and a blue image signal B to display blue light.

The on-pixel ratio calculator 122 may calculate the on-pixel ratio of the image signal R, G, B every frame based on a red on-pixel ratio OPRr of the red image signal R, a green on-pixel ratio OPRg of the image color signal G, and a blue on-pixel ratio OPRb of the blue image signal B. The red on-pixel ratio OPRr of the red image signal R represents a ratio of the number of all pixels that displays the red image signal R to the number of turned-on pixels that display the red image signal R. The green on-pixel ratio OPRg of the green color signal G represents a ratio of the number of all pixels that display the green image signal G to the number of turned-on pixels that displays the green image signal G. The blue on-pixel ratio OPRb of the blue color signal B represents a ratio of the number of all pixels that display the blue image signal B to the number of turned-on pixels that displays the blue image signal B.

In one embodiment, the on-pixel ratio OPR of the image signal R, G, B provided during one frame may be calculated based on an Equation 1.

$$N=AKr\mathrm{OPR}r+AKg\mathrm{OPR}g+AKb\mathrm{OPR}b \quad (1)$$

In Equation 1, N is the on-pixel ratio of the image signal, OPRr is the red on-pixel ratio, OPRg is the green on-pixel ratio, OPRb is the blue on-pixel ratio, Akr is a coefficient based on a material property of an organic light emission diode that emits red light, Akg is a coefficient based on a material property of an organic light emission diode that emits green light, and Akb is a coefficient based on a material property of an organic light emission diode that emits blue light.

In another embodiment, the on-pixel ratio OPR of the image signal R, G, B input during one frame may calculated based on Equation 2.

$$N=BKr\mathrm{OPR}r+BKg\mathrm{OPR}g+BKb\mathrm{OPR}b \quad (2)$$

In Equation 2, N is the on-pixel ratio of the image signal, OPRr is the red on-pixel ratio, OPRg is the green on-pixel ratio, OPRb is the blue on-pixel ratio, Bkr is a coefficient based on a material property of an organic light emission diode that emits red light, Bkg is a coefficient based on a material property of an organic light emission diode that emits green light, and dBkb is a coefficient based on a material property of an organic light emission diode that emits blue light. In one embodiment, BKr, Bkg, and Bkb may be values that reflect an efficiency of the blue on-pixel ratio of the blue image signal B.

The on-pixel calculator 122 may calculate the on-pixel ratio OPR of the image signal R, G, B based on Equation 1 or 2. For example, the on-pixel ratio calculator 122 may calculate the on-pixel ratio OPR of the image signal R G, B using Equation 1 when the blue on-pixel ratio OPRb of the blue image signal B is lower than the red on-pixel ratio OPRr of the red image signal R and the green on-pixel ratio OPRg of the green image signal G. The on-pixel ratio calculator 122 may calculate the on-pixel ratio OPR of the image signal R, G, B using Equation 2 when the blue on-pixel ratio OPRb of the blue image signal B is higher than the red on-pixel ratio OPRr of the red image signal R and the green on-pixel ratio OPRg of the green image signal G. The on-pixel ratio calculator 122 may further include an average filter for preventing distortion of the image signal R, G, B that may occur by rapidly changing the on-pixel ratio OPR. The on-pixel ratio calculator 122 may provide the on-pixel ratio OPR of the image signal R, G, B to the compensating data calculator 124.

The compensating data calculator 124 may calculate the compensating data ACL_DY corresponding to the on-pixel ratio OPR. Referring to FIG. 2, the compensating data calculator 124 may calculate the compensating data ACL_DY corresponding to the on-pixel ratio OPR when the on-pixel ratio OPR is higher than a predetermined reference grayscale data level ACL_START_STEP.

To decrease the driving current of the image signal R, G, B (e.g., power consumption of a display device), an automatic current limitation ACL method that decreases a grayscale in a high brightness range may be used. The driving current of the image signal R, G, B may be changed based on the on-pixel ratio OPR of the image signal R, G, B. Thus, the image processing device 100 may not use the automatic current limitation ACL method when the on-pixel ratio OPR of the image R, G, B is lower than the reference grayscale data level ACL_START_STEP.

The compensating data calculator 124 may calculate the compensating data ACL_DY by comparing the on-pixel ratio OPR of the image signal R, G, B to the predetermined reference grayscale data level ACL_STRAT_STEP. For example, the compensating data calculator 124 may calculate the compensating data ACL_DY when the on-pixel ratio OPR of the image signal R, G, B is higher than the reference grayscale data level SCL_START_STEP. The compensating data calculator 124 may not calculate the compensating data ACL_DY when the on-pixel ratio OPR of the image signal R, G, B is lower than the reference grayscale data level SCL_START_STEP.

Referring to FIG. 2, the compensating data calculator 124 may calculate the compensating data ACL_DY corresponding to the on-pixel ratio OPR based on Equation 3 when the on-pixel ratio OPR of the image signal R, G, B is N and the N is between the reference grayscale data level ACL_STRAT_STEP and the maximum grayscale data level ACL_MAX_STEP.

$$\text{ACL_DY} = \text{ACL_OFF_MAX} \times \frac{N - \text{ACL_START_STEP}}{\text{ACL_MAX_STEP} - \text{ACL_START_STEP}} \tag{3}$$

In Equation 3, ACL_DY is the compensating data, the ACL_OFF_MAX is the maximum compensating data, N is the on-pixel ratio, ACL_START_STEP is the reference grayscale data level, and ACL_MAX-STEP is the maximum grayscale data level. The maximum grayscale data level ACL_MAX_STEP represents the maximum grayscale data of grayscale data levels of the image signal R, G, B. For example, the maximum grayscale data level ACL_MAX_STEP may be 1023 when the display device is driven in 10 bit.

The maximum compensating data ACL_OFF_MAX is a predetermined value. For example, the maximum compensating data ACL_OFF_MAX represents the maximum compensating data ACL_DY calculated when the automatic current limitation ACL method is adjusted. For example, the maximum compensating data ACL_OFF_MAX may be the same as or lower than 1023 when the maximum grayscale data level ACL_MAX-STEP is 1023. The maximum compensating data ACL-OFF MAX may be stored in a memory device. The compensating data calculator 124 may calculate the compensating data ACL_DY by reading the maximum compensating data ACL_OFF_MAX stored in the memory device.

The compensation brightness calculator 126 may calculate the compensation brightness data ACL_DBV based on compensating data ACL_DY. The compensation brightness calculator 126 may calculate the compensation brightness data ACL_DBV based on the compensating data ACL_DY and an input brightness DBV. The compensation brightness calculator 126 may calculate the compensation brightness data ACL_DBV based on Equation 4.

$$\text{ACL_DBV} = DBV \times \left(1 - \frac{\text{ACL_DY}}{\text{ACL_MAX_STEP}}\right) \tag{4}$$

In Equation 4, ACL_DBV is the compensation brightness data, DBV is the input brightness, ACL_DY is the compensating data, and ACL_MAX_STEP is the maximum grayscale data level. The input brightness DBV represents a brightness set, for example, by a production company or manufacturer. Thus, the input brightness DBV may be changed by the production company or manufacturer.

Referring to FIG. 3, the compensation brightness data ACL_DBV may be changed when the compensating data ACL_DY is changed, even when the input brightness DBV is the same. The compensating brightness data ACL_DBV may decrease as the compensating data ACL_DY increases.

For example, when the input brightness DBV is 740 nit and the compensating data ACL_DY is 0, the compensating brightness calculator 126 may output 740 nit that is the same with the input brightness DBV. The compensation brightness calculator 126 may output 369 nit that is the compensating brightness data ACL_DBV based on the Equation 4 when the input brightness DBV is 740 set by the production company and the compensating data ACL_DY is 512. The compensation brightness calculator 126 may change the compensating brightness data ACL_DBV to a digital value and provide the digital value to the brightness controller 140.

The brightness controller 140 may select a gamma set GAMMA SET and a dimming value AID based on the compensating brightness data ACL_DBV. The brightness controller 140 may include a gamma unit and a dimming unit. The gamma unit may store the plurality of gamma sets GAMMA SET. Each of the gamma sets GAMMA SET may generate reference gamma voltages that have different voltage levels. The brightness controller 140 may select one of the gamma sets GAMMA SET based on the compensating brightness data ACL_DBV. The brightness controller 140 may provide the gamma set GAMMA SET to a data driver of the display device.

In one embodiment, the gamma unit may include a linear interpolator. The dimming unit may store dimming values AID. The brightness controller 140 may select one of the dimming values AID based on the compensation brightness data ACL_DBV. The brightness controller 140 may output the dimming value AID to an emission controller of the display device. For example, the brightness controller 140 may select the dimming value AID that decreases an off-duty of the emission control signal as the compensation brightness data ACL_DBV increases. In one embodiment, the dimming unit may include a linear interpolator.

According to one approach, an automatic current limitation ACL method may remap the image signal R, G, B based on the compensating data ACL_DY, calculated based on the on-pixel ratio OPR. In this case, loss of data may occur during the remapping process. As described above, in accordance with on embodiment, the image processing device 100 of FIG. 1 may calculate the compensating data ACL_DY based on the on-pixel ratio OPR and control the gamma set GAMMA SET and the dimming value AID by calculating the compensation brightness data ACL_DBV based on the compensating data ACL_DY. Thus, the driving current of the image signal R, G, B may be decreased without data loss.

Figure 4:
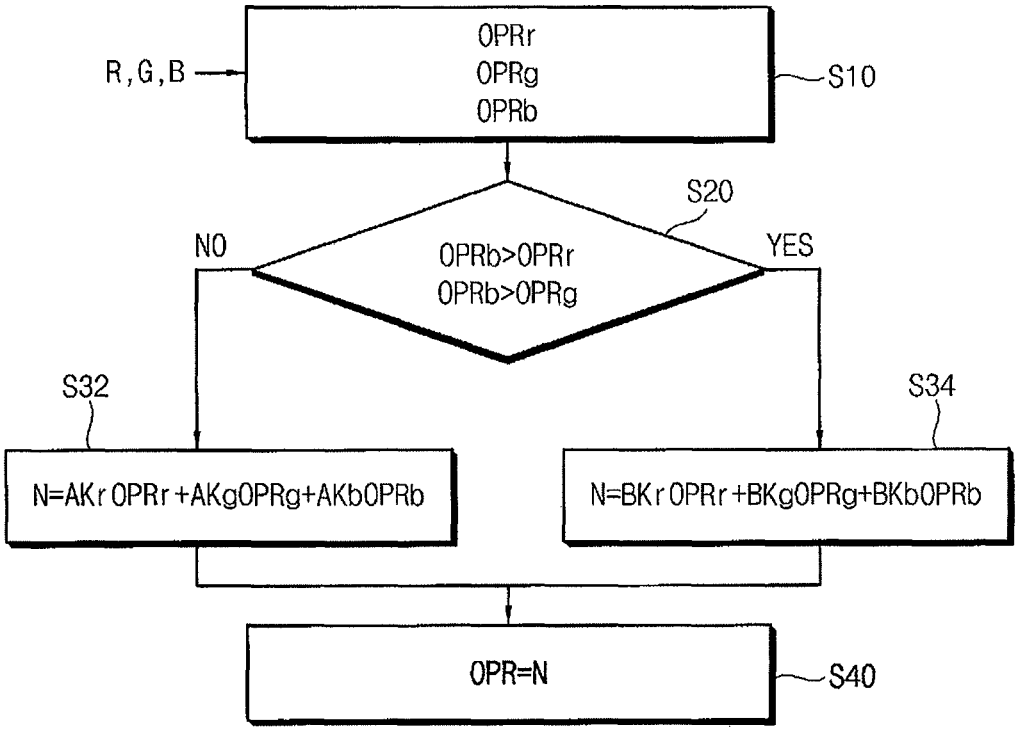
FIG. 4 illustrates an example operation of an on-pixel ratio calculator.

FIG. 4 illustrates an example of the operation of an on-pixel ratio calculator, which, for example, may be included in the image processing device 100. Referring to FIG. 4, the on-pixel ratio calculator 122 may calculate the on-pixel ratio OPR of the image signal R, G, B. The on-pixel ratio calculator 122 may calculate the on-pixel ratio of the image signal R, G, B every frame based on a red on-pixel ratio OPRr of the red image signal R, a green on-pixel ratio OPRg of the green image signal G, and a blue on-pixel ratio OPRb of the blue image signal B (S10).

The red on-pixel ratio OPRr of the red image signal R represents a ratio of all pixels that display the red image signal R to the number of turned-on pixels that display the red image signal R. The green on-pixel ratio OPRg of the green color signal G represents a ratio of the number of all pixels that display the green image signal G to the number of turned-on pixels that displays the green image signal G. The blue on-pixel ratio OPRb of the blue color signal B represents a ratio of the number of all pixels that display the blue image signal B to the number of turned-on pixels that displays the blue image signal B.

The on-pixel ratio calculator 122 may compare the blue on-pixel ratio OPRb of the blue image signal B to the red on-pixel ratio OPRr of the red image signal R and the green on-pixel ratio OPRg of the green image signal G (S20). The on-pixel ratio calculator 122 may calculate the on-pixel ratio OPR based on Equation 1 when the blue on-pixel ratio OPRb of blue image signal B is lower than the red on-pixel ratio OPRr of red image signal R and the green on-pixel ratio OPRg of green image signal G (S32).

The on-pixel ratio calculator 122 may calculate the on-pixel ratio OPR based on Equation 2 when the blue on-pixel ratio OPRb of the blue image signal B is higher than the red on-pixel ratio OPRr of the red image signal R and the green on-pixel ratio OPRg of the green image signal G (S34).

The on-pixel ratio OPR calculated based on Equation 2 may be a value that reflects the efficiency of the blue on-pixel ratio of the blue image signal B. The on-pixel ratio calculator 122 may output the on-pixel ratio OPR calculated based on Equation 1 or Equation 2 (S40).

Figure 5:
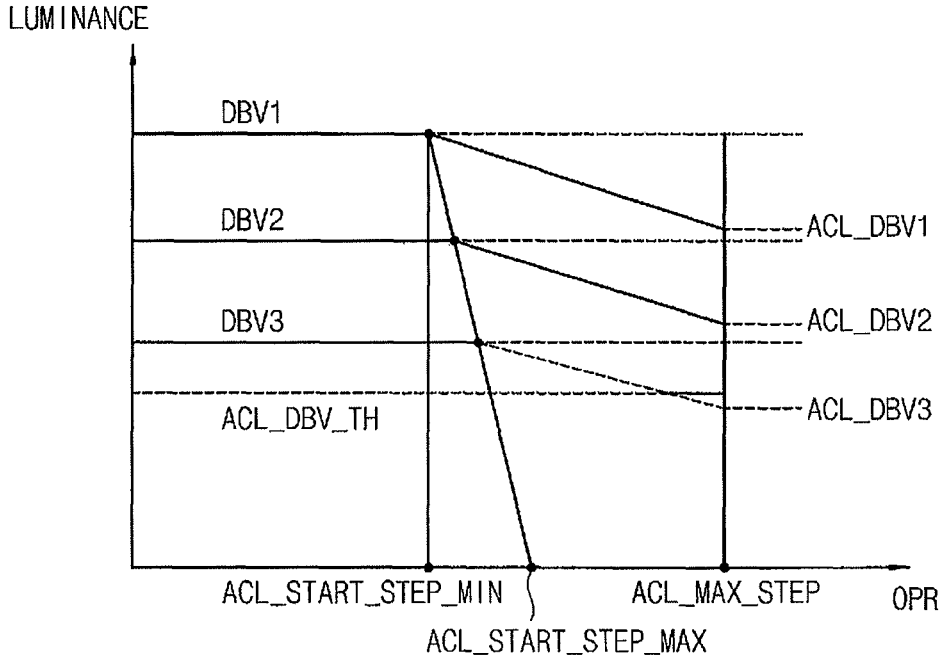
FIG. 5 illustrates an example of the operation of a current limiter.

FIG. 5 is a graph illustrating an example of the operation of the current limiter 120 in the image processing device 100. Referring to FIG. 5, the current limiter 120 may calculate the compensation brightness data ACL_DBV based on the input brightness DBV. The current limiter 120 may change the reference grayscale data level ACL_START_STEP based on the input brightness DBV. The current limiter 120 may expand a range to which the automatic current limitation ACL method is adjusted (e.g., a range between the reference grayscale data level ACL_STRAT_STEP and the maximum grayscale data level ACL_MAX_STEP). This may be accomplished by decreasing the reference grayscale data level ACL_START_STEP, because the driving current increases as the input brightness DBV increases.

For example, the current limiter 120 may change the reference grayscale data ACL_START_STEP in the range between the predetermined minimum value ACL_START_STEP_MIN and the maximum value ACL_SRATR_STEP based on the input brightness DBV as in FIG. 5. A threshold brightness data ACL_DBV_TH may be set for preventing the compensation brightness data ACL_DBV to decrease below a predetermined level. For example, the compensation brightness data ACL_DBV3 may decrease below the threshold brightness data ACL_DBV_TH when the current limiter 120 calculates the input brightness DBV3 based on Equation 4 as described in FIG. 5. The current limiter 120 may output the threshold brightness data ACL_DBV_TH, not the compensation brightness data ACL_DBV3.

Figure 6:
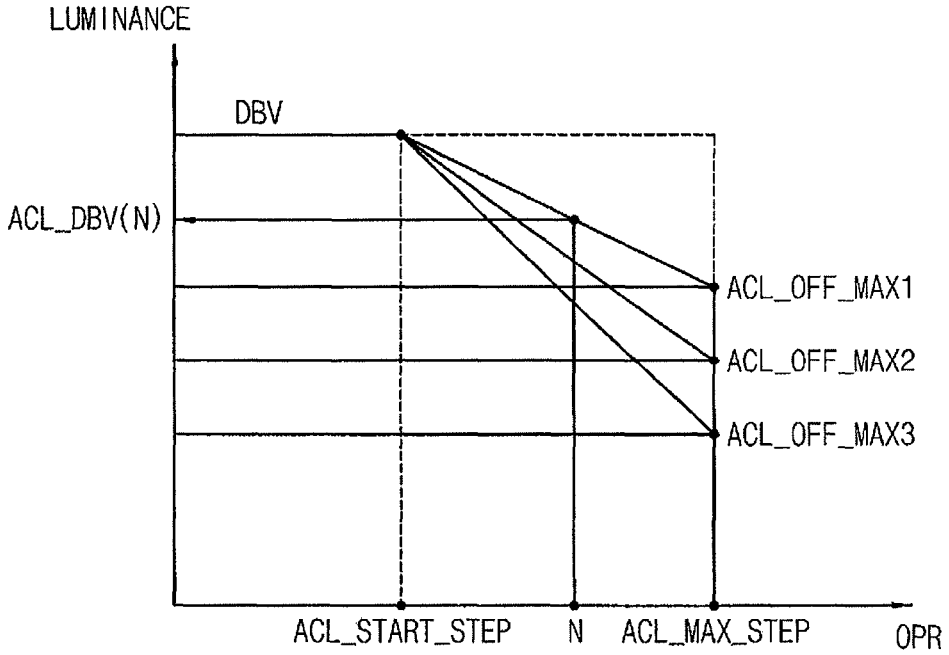
FIG. 6 illustrates another example of the operation of a current limiter.

FIG. 6 is a graph illustrating another example of an operation of a current limiter 120 in the image processing device. Referring to FIG. 6, the current limiter 120 may select one of the maximum compensating data ACL_OFF_MAX1, ACL_OFF_MAX2, or ACL_OFF_MAX3. The current limiter 120 may output the compensation brightness data ACL_DBV having different values, even when the input brightness DBV is the same, because the compensating data ACL_DY is changed when the maximum compensating data ACL_OFF_MAX is changed. For example, the current limiter 120 may change an amount of compensation (e.g., compensating data ACL_DY) by storing the maximum compensating data ACL_OFF_MAX1, ACL_OFF_MAX2, and ACL_OFF_MAX3 and may selectively output one of the maximum compensating data ACL_OFF_MAX1, ACL_OFF_MAX2, ACL_OFF_MAX3 when the automatic current limitation ACL method is adjusted.

The maximum compensating data ACL_OFF_MAX1, ACL_OFF_MAX2, ACL_OFF_MAX3 may be stored in the memory device. The compensating data calculator 124 may selectively read one of the maximum compensating data ACL_OFF_MAX1, ACL_OFF_MAX2, or ACL_OFF_MAX3 from the memory device.

Figure 7:
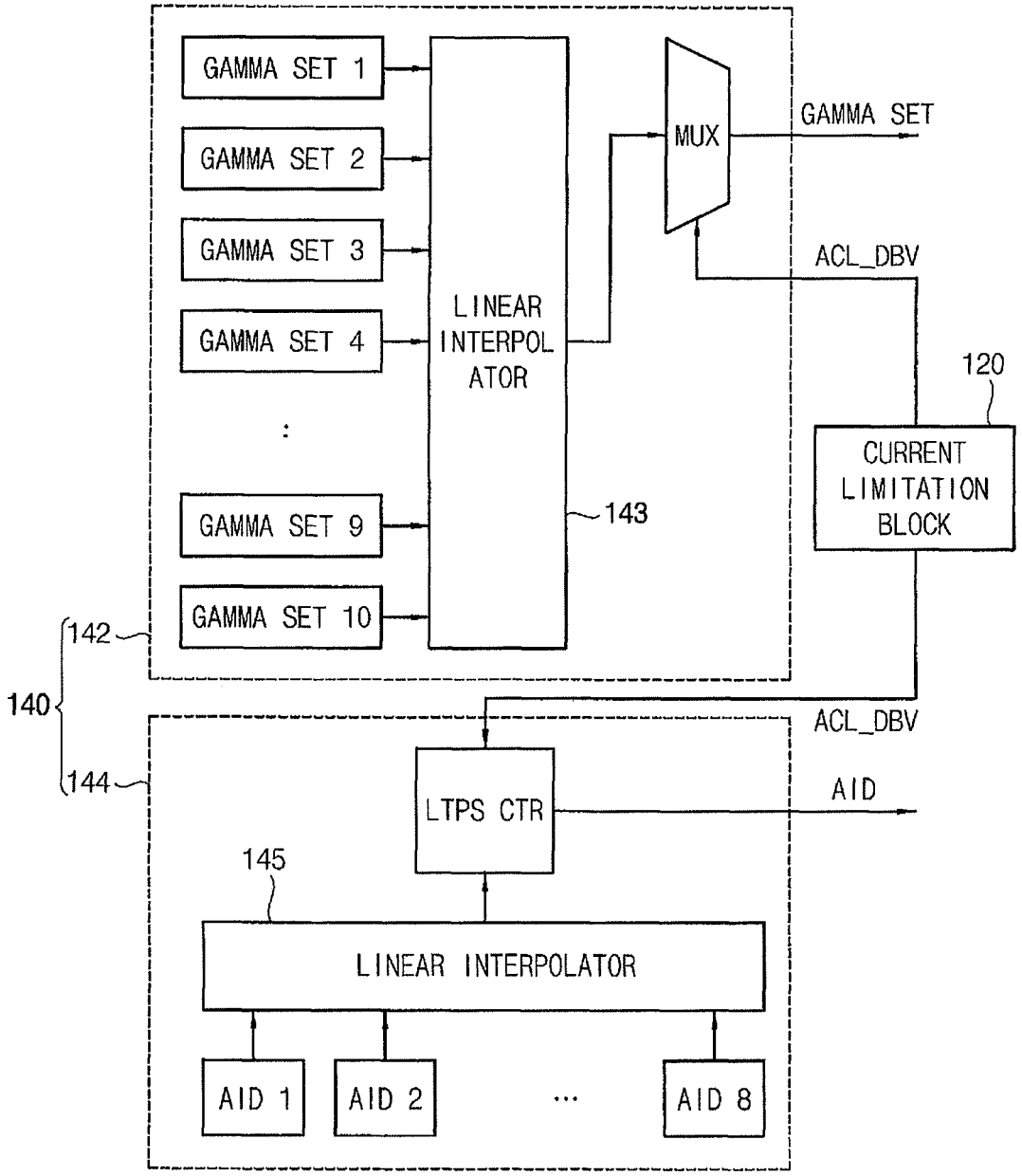
FIG. 7 illustrates an example operation of a brightness controller.

FIG. 7 illustrates an example of the operation of the brightness controller 140 in the image processing device 100. Referring to FIG. 7, the brightness controller 140 may select the gamma set GAMMA SET and the dimming value AID based on the compensation brightness data ACL_DBV.

Referring to FIG. 7, the brightness controller 140 may select the gamma set GAMMA SET and the dimming value AID based on the compensation brightness data ACL_DBV. The brightness controller 142 may include the gamma unit 142 and the dimming unit 144. The gamma unit 142 may store the a plurality of gamma sets GAMMA SET1, . . . , GAMMA SET10, and the brightness controller 140 may select one of the gamma sets GAMMA SET1, . . . , GAMMA SET10 based on the compensation brightness data ACL_DBV. The brightness controller 140 may provide the selected gamma set GAMMA SET to the data driver of the display device.

In one embodiment, the gamma unit 142 may include the linear interpolator 143. The dimming unit may store the plurality of dimming values AID1, . . . , AID8. The brightness controller 140 may select one of the dimming values AID1, . . . , AID8 based on the compensation brightness data ACL_DBV. The brightness controller 140 may output the selected dimming value AID to the emission control driver of the display device. For example, the brightness controller 140 may select the dimming value AID that decreases the off-duty of the emission control signal as the compensation brightness data ACL_DBV increases. The dimming unit 144 may include linear interpolator 145.

Figure 8:
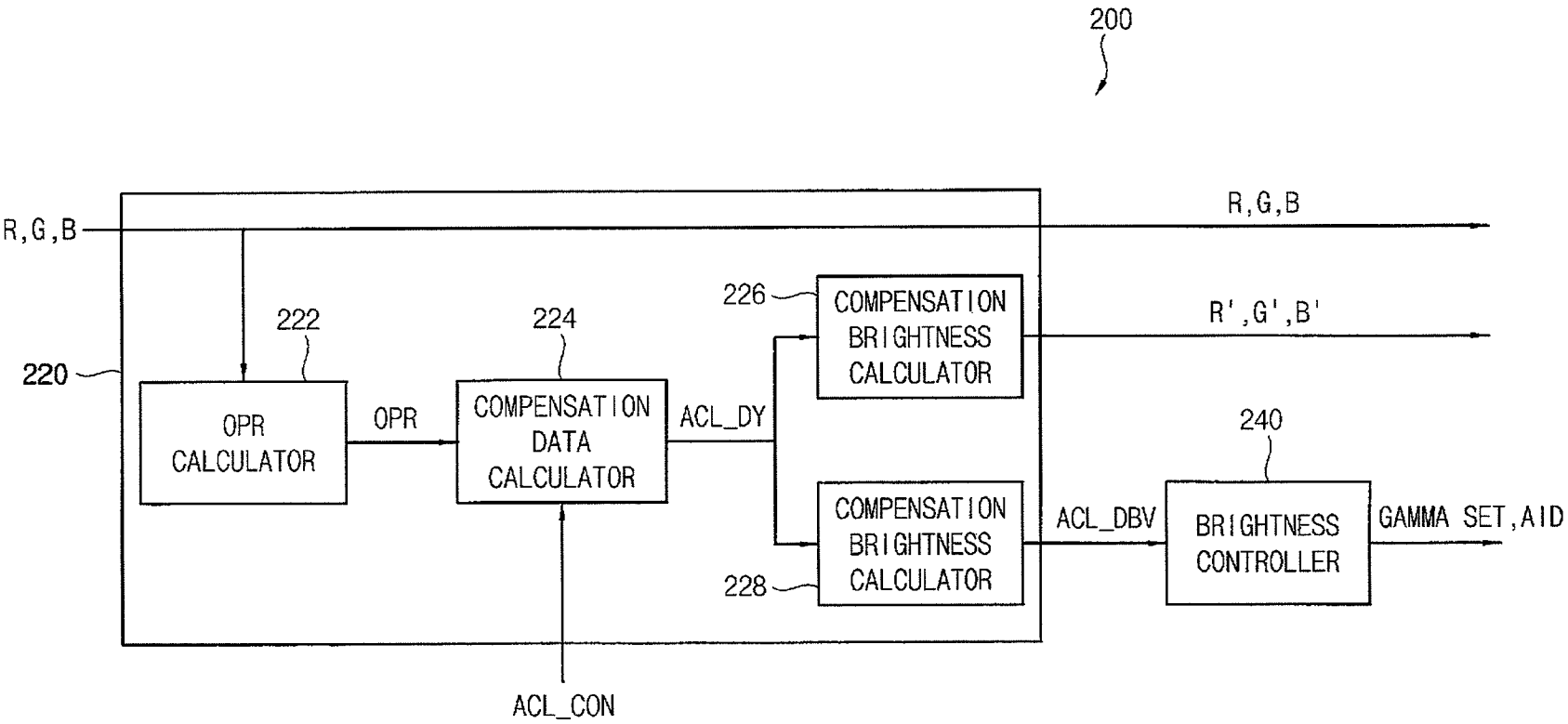
FIG. 8 illustrates an embodiment of an image processing device.

FIG. 8 illustrates another embodiment of an image processing device 200 which includes a current limiter 220 and a brightness controller 240. The current limiter 220 may include an on-pixel ratio calculator 222, a compensating data calculator 224, a data converter 226, and a compensation brightness calculator 228. The on-pixel ratio calculator 222 may calculate the on-pixel ratio OPR of an image signal R, G, B. The on-pixel calculator 222 may calculate the on-pixel ratio OPR using Equation 1 or 2. The on-pixel ratio calculator 222 may provide the on-pixel ratio OPR of the image signal R, G, B to the compensating data calculator 224.

The compensating data calculator 224 may calculate the compensating data ACL_DY corresponding to the on-pixel ratio OPR. The compensating data calculator 224 may calculate the compensating data ACL_DY when the on-pixel ratio OPR of the image signal R, G, B is higher than a predetermined reference grayscale data level. The compensating data calculator 224 may calculate the compensating data ACL_DY corresponding to the on-pixel ratio OPR based on Equation 3.

The compensating data calculator 224 may receive ACL control signal ACL_CON that determines whether to adjust a method of the automatic current limitation ACL. The compensating data calculator 224 may provide the compensating data ACL_DY to the data converter 226 or the compensation brightness calculator 228 based on the ACL control signal ACL_CON.

The data converter 226 may remap the image signal R, G, B based on the compensating data ACL_DY. The remapped image data R', G', B' may be provided to the data driver of the display device. The data driver may generate a data signal based on the remapped image data R', G', B'.

The compensation brightness calculator 228 may calculate the compensation brightness data ACL_DBV based on the compensating data ACL_DY. The brightness controller 240 may select a gamma set GAMMA SET and a dimming value AID based on the compensation brightness data ACL_DBV. The gamma set GAMMA SET may be provided to the data driver. The data driver may generate the data signal based on the image signal R, G, B and the gamma set GAMMA SET. Further, the dimming value AID may be provided to the emission controller, and the emission controller may generate the emission control signal based on the dimming value AID.

As described above, the image processing device 200 of FIG. 8 may calculate the compensating data ACL_DY based on the on-pixel ratio OPR. The image processing device 200 may selectively remap the image signal R, G, B or control the brightness of the image signal R, G, B based on the ACL control signal ACL_CON from the compensating data calculator 224.

Figure 9:
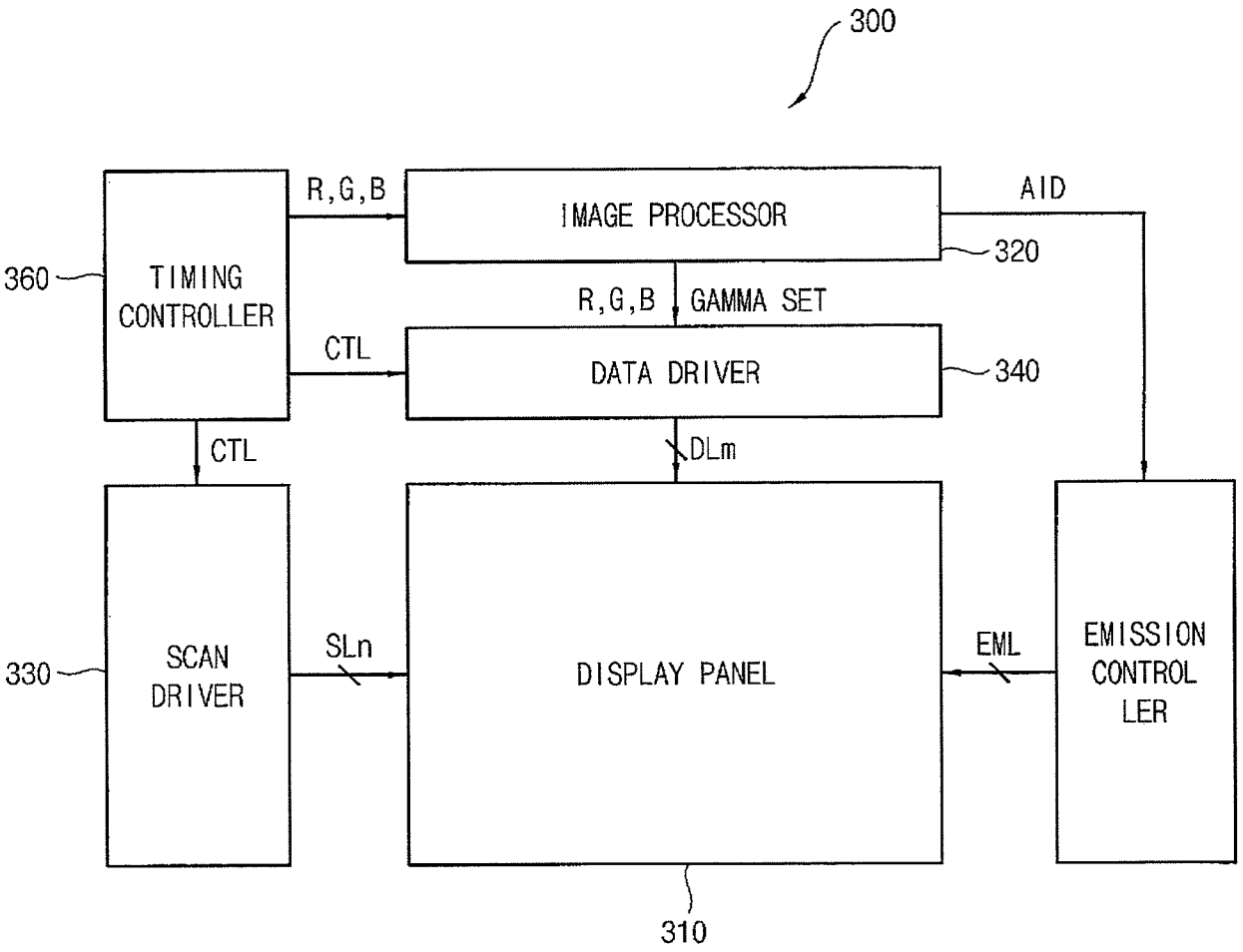
FIG. 9 illustrates an embodiment of a display device.

FIG. 9 illustrates an embodiment of a display device 300 which includes a display panel 310, an image processor 320, a scan driver 330, a data driver 340, an emission controller 350, and a timing controller. The image processor 320 of FIG. 9 may correspond, for example, to the image processing device 100 of FIG. 1.

The display panel 310 includes a plurality of pixels. A plurality of data lines DLm and a plurality of scan lines SLn may be disposed on the display panel 310. The pixels may be formed at intersection regions of the data line DLm and the scan line SLn. In one example embodiment, each of the pixels may include a pixel circuit, a driving transistor, and an organic light emitting diode. The driving transistor may control a driving current flowing through the organic light emitting diode based on the data signal. The data signal is provided to the driving transistor via the data line in response to the scan signal provided via the scan line.

The image processor 320 may calculate a compensating data that decreases the driving current of the display panel 310 based on an on-pixel ratio of an image signal R, G, B and may control a brightness of the image signal R, G, B based on the compensating data.

The image processor 320 may include a current limiter and a brightness controller. The current limiter may calculate the compensating data based on the on-pixel ratio and may calculate a compensation brightness data of the image signal R, G, B based on the compensating data. The current limiter may include an on-pixel ratio calculator, a compensating data calculator, and a compensation brightness calculator. The on-pixel ratio calculator may calculate the on-pixel ratio of image signal R, G, B.

The on-pixel ratio calculator may calculate the on-pixel ratio of the image signal every frame based on a red on-pixel ratio of red pixels, a green on-pixel ratio of green pixels, and a blue on-pixel ratio of blue pixels. The on-pixel ratio calculator may calculate the on-pixel ratio of the image signal R, G, B using Equation 1 or 2 based on an efficiency of the blue on-pixel ratio.

For example, the on-pixel ratio calculator may calculate the on-pixel ratio using Equation 1 when the blue on-pixel ratio is lower than the red on-pixel ratio and the green on-pixel ratio. The on-pixel ratio calculator may calculate the on-pixel ratio using Equation 2 when the blue on-pixel ratio is higher than the red on-pixel ratio and the green on-pixel ratio.

The compensating data calculator may calculate the compensating data corresponding to the on-pixel ratio. The compensating data calculator may calculate the compensating data corresponding to the on-pixel ratio when the on-pixel ratio of the image signal R, G, B is higher than a reference grayscale data level. The compensating data calculator may not calculate the compensating data when the on-pixel ratio of the image signal R, G, B is lower than the reference grayscale data level. The compensating data calculator may compensate the compensating data based on a maximum compensating data, the on-pixel ratio, the reference grayscale data level, and a maximum grayscale data level.

The maximum grayscale data level represents the highest grayscale data level of the grayscale data level of the image signal R, G, B. Further, the maximum compensating data may be a predetermined value. The maximum compensating data represents the highest value to be calculated when the automatic current limitation method is adjusted. The compensating data may be calculated using Equation 3.

The compensation brightness calculator may calculate the compensation brightness data based on the compensating data. The compensation brightness calculator may calculate the compensation brightness data based on the compensating data and an input brightness. The input brightness may be set by a production company or manufacturer. The compensation brightness data may be calculated using Equation 4.

The compensation brightness calculator may provide the compensation brightness data to the brightness controller by converting the compensation brightness data to a digital signal. The brightness controller may select a gamma set GAMMA SET and a dimming value AID based on the compensation brightness data. The brightness controller may include a gamma unit and a dimming unit. The gamma unit may store a plurality of gamma set GAMMA SET. The brightness controller may select one of the gamma set GAMMA SET based on the compensation brightness data and provide the selected gamma set GAMMA SET to the data driver 340 of the display device 300.

In one embodiment, the gamma unit may include a linear interpolator. The dimming unit may store a plurality of dimming values AID. The brightness controller may select one of the dimming values AID based on the compensation brightness data and may provide the selected dimming value AID to the emission controller 350 of the display device 300. For example, the brightness controller may select the dimming value that decreased an off-duty of the emission control signal as the compensation brightness data increases. The dimming unit may also include a linear interpolator.

The scan driver 330 provides a scan signal to the pixels via the scan lines SLn. The data driver 340 provides data signals to the pixels via the data lines DLm. The data driver 340 may generate the data signal corresponding to the data voltage generated based on the image signal R, G, B and the gamma set GAMMA SET from the image processor 320. The emission controller 350 provides emission control signals to the pixels through emission control lines EML. The emission controller 350 may generate the emission control signal based on the dimming value AID from image processor 320.

The timing controller 360 may generate control signals CTL that controls the image processor 320, the scan driver 330, the data driver 340, and the emission controller 350. The image processor 320 may be coupled to the data driver 340 as in FIG. 9. Alternatively, the image processor 320 may be located in the data driver 340. Further, the image processor 320 may be coupled to the timing controller 360 or be located in the timing controller 360.

As described above, the display device 300 of FIG. 9 may include the image processor 320 that calculates the compensating data based on the on-pixel ratio, calculates the compensation brightness data based on the compensating data, and controls the gamma set and the dimming value based on the compensation brightness data. Thus, the driving current of the image signal R, G, B may decrease without loss of image data R, G, B.

Figure 10:
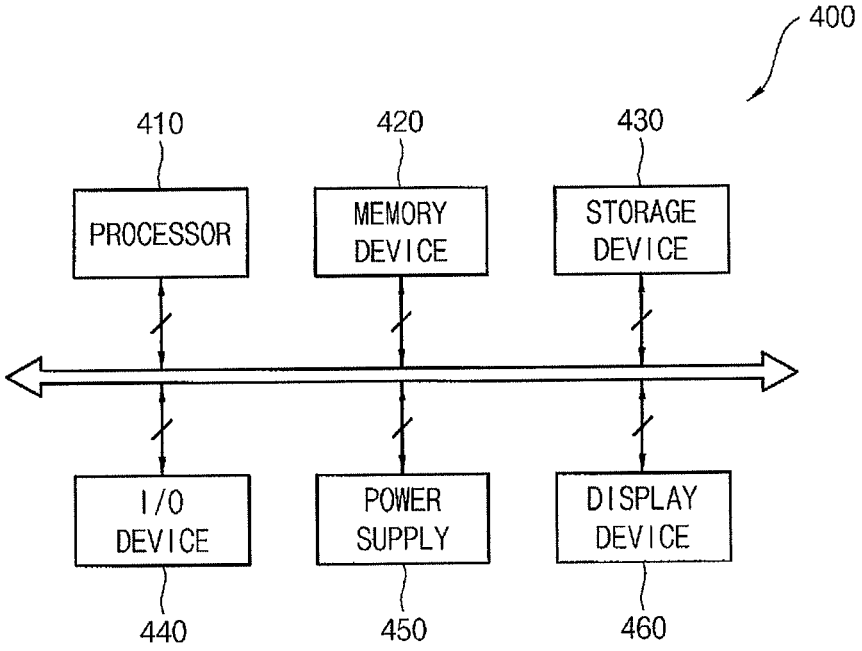
FIG. 10 illustrates an embodiment of an electronic device.
Figure 11:
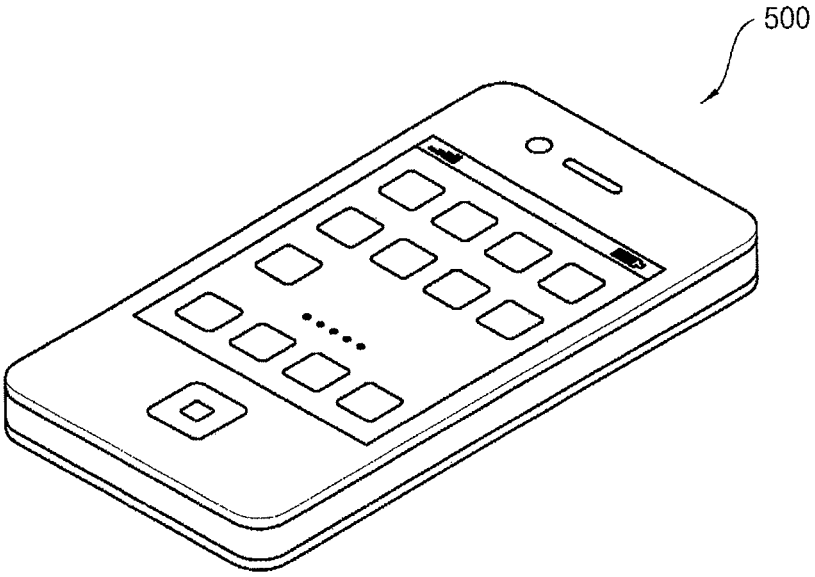
FIG. 11 illustrates an embodiment of a smart phone.

FIG. 10 illustrates an embodiment of an electronic device 400 that includes the display device of FIG. 9, and FIG. 11 illustrates an example of the electronic device in FIG. 10 in the form of a smart phone.

Referring to FIGS. 10 and 11, the electronic device 400 includes a processor 410, a memory device 420, a storage device 430, an input/output (I/O) device 440, a power device 450, and a display device 460. The display device 460 may correspond to the display device 300 of FIG. 9. In addition, the electronic device 400 may include a plurality of ports for communicating a video card, a sound card, a memory card, a universal serial bus (USB) device, other electronic device, etc. Although it is illustrated in FIG. 8 that the electronic device 400 is implemented as a smart-phone 500, the electronic device 400 may be another kind of electronic device in a different embodiment.

The processor 410 may perform various computing functions. The processor 410 may be a micro processor, a central processing unit (CPU), etc. The processor 410 may be coupled to other components via an address bus, a control bus, a data bus, etc. Further, the processor 410 may be coupled to an extended bus such as peripheral component interconnect (PCI) bus.

The memory device 420 may store data for operations of the electronic device 200. For example, the memory device 420 may include at least one non-volatile memory device such as an erasable programmable read-only memory (EPROM) device, an electrically erasable programmable read-only memory (EEPROM) device, a flash memory device, a phase change random access memory (PRAM) device, a resistance random access memory (RRAM) device, a nano floating gate memory (NFGM) device, a polymer random access memory (PoRAM) device, a magnetic random access memory (MRAM) device, a ferroelectric random access memory (FRAM) device, etc, and/or at least one volatile memory device such as a dynamic random access memory (DRAM) device, a static random access memory (SRAM) device, a mobile DRAM device, etc. The storage device 430 may be a solid stage drive (SSD) device, a hard disk drive (HDD) device, a CD-ROM device, etc.

The I/O device 440 may be an input device such as a keyboard, a keypad, a touchpad, a touch-screen, a mouse, etc, and an output device such as a printer, a speaker, etc. In one example embodiment, the display device 460 may be included in the I/O device 440. The power device 450 may provide a power for operations of the electronic device 200. The display device 460 may communicate with other components via the buses or other communication links.

As described above, the display device may include a display panel, an image processor, a scan driver, a data driver, an emission controller, and a timing controller. The display panel may include a plurality of pixels. The image processor may calculate a compensating data corresponding to an on-pixel ratio of an image signal and may output a gamma set and a dimming value that controls a brightness of the image signal based on the compensating data. The data driver may generate a data signal corresponding to the data voltage based on the image signal and the gamma set. The emission controller may generate an emission control signal based on the dimming value provided form the image processor. The scan driver may provide the scan signal to the pixels through the scan lines. The timing controller may generate control signals that control the image processor, the data driver, the scan driver, and the emission controller.

As described above, the electronic device 400 of FIG. 10 may decrease a driving current of the image signal, without loss of image data, by including the display device 460 that calculates the compensating data based on the on-pixel ratio of the image signal and controls the brightness of the image signal based on the compensating data. Thus, power consumption of the electronic device 400 may be reduced.

The aforementioned embodiments may be applied to a display device and an electronic device having the display device. Examples include a computer monitor, a laptop, a digital camera, a cellular phone, a smart phone, a smart pad, a television, a personal digital assistant (PDA), a portable multimedia player (PMP), a MP3 player, a navigation system, a game console, a video phone, etc.

The methods, processes, and/or operations described herein may be performed by code or instructions to be executed by a computer, processor, controller, or other signal processing device. The computer, processor, controller, or other signal processing device may be those described herein or one in addition to the elements described herein. Because the algorithms that form the basis of the methods (or operations of the computer, processor, controller, or other signal processing device) are described in detail, the code or instructions for implementing the operations of the method embodiments may transform the computer, processor, controller, or other signal processing device into a special-purpose processor for performing the methods described herein.

The controllers, calculators, and other processing features of the embodiments disclosed herein may be implemented in logic which, for example, may include hardware, software, or both. When implemented at least partially in hardware, the controllers, calculators, and other processing features may be, for example, any one of a variety of integrated circuits including but not limited to an application-specific integrated circuit, a field-programmable gate array, a combination of logic gates, a system-on-chip, a microprocessor, or another type of processing or control circuit.

When implemented in at least partially in software, the controllers, calculators, and other processing features may include, for example, a memory or other storage device for storing code or instructions to be executed, for example, by a computer, processor, microprocessor, controller, or other signal processing device. The computer, processor, microprocessor, controller, or other signal processing device may be those described herein or one in addition to the elements described herein. Because the algorithms that form the basis of the methods (or operations of the computer, processor, microprocessor, controller, or other signal processing device) are described in detail, the code or instructions for implementing the operations of the method embodiments may transform the computer, processor, controller, or other signal processing device into a special-purpose processor for performing the methods described herein.

By way of summation and review, a variety of flat panel displays have been developed. These displayer are widely in electronic devices because they are thin and lightweight compared to cathode-ray tube displays. Examples of flat panel displays include liquid crystal displays, field emission displays, plasma display panels, and organic light emitting displays (OLEDs). OLED displays have a wide viewing angle, fast response speed, low power consumption, and are thin. As the size and resolution of flat panel displays increases, power consumption is expected to increase.

In accordance with one or more of the aforementioned embodiments, an image processing device may calculate a compensating data based on an on-pixel ratio (OPR) and control a gamma set and a dimming value, by calculating a compensation brightness data based on the compensating data. Thus, the driving current of an image signal may be decreased without data loss.

Example embodiments have been disclosed herein, and although specific terms are employed, they are used and are to be interpreted in a generic and descriptive sense only and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope of the present invention as set forth in the following claims.

What is claimed is:

1. An image processing device, comprising:

a current limiter to calculate compensating data based on an on-pixel ratio of an image signal and to calculate a compensation brightness data of the image signal based on the compensating data, the compensating data to decrease a driving current of the image signal; and a brightness controller to select one of a plurality of gamma sets and one of a plurality of dimming values based on the compensation brightness data, wherein:

the compensating data are grayscale data, and the compensation brightness data are luminance data, wherein the current limiter includes a compensation brightness calculator to calculate the compensation brightness data based on the compensating data and an input brightness, and wherein a brightness of the image signal is controlled without remapping or converting the image signal.

2. The device as claimed in claim 1, wherein the current limiter further includes:

an on-pixel ratio calculator to calculate the on-pixel ratio of the image signal; and a compensating data calculator to calculate the compensating data corresponding to the on-pixel ratio.

3. The device as claimed in claim 2, wherein the compensating data calculator is to calculate the compensating data when the on-pixel ratio is higher than a predetermined reference grayscale data level.

4. The device as claimed in claim 2, wherein the compensating data calculator is to calculate the compensating data based on a reference grayscale data level, a maximum grayscale data level, and a predetermined maximum compensating data.

5. The device as claimed in claim 2, wherein the on-pixel ratio calculator is to calculate the on-pixel ratio of the image signal based on a red on-pixel ratio that is the on-pixel ratio of a red image signal in the image signal, a green on-pixel ratio that is the on-pixel ratio of a green image signal in the image signal, and a blue on-pixel ratio that is the on-pixel ratio of a blue image signal in the image signal.

6. The device as claimed in claim 1, wherein the brightness controller is to select one of the gamma sets based on the compensating brightness data.

7. The device as claimed in claim 1, wherein the brightness controller is to select one of the dimming values based on the compensating brightness data.

8. A display device, comprising:

a display panel including a plurality of pixels;

an image processor to calculate compensating data based on an on-pixel ratio of an image signal when the image signal is displayed on the display panel and to control a brightness of the image signal based on the compensating data, the compensating data to decrease a driving current of the display panel;

a scan driver to provide a scan signal to the pixels;

a data driver to provide a data signal to the pixels;

an emission controller to provide an emission control signal to the pixels; and a controller to generate control signals to control the image processor, the scan driver, the data driver, and the emission controller, wherein the image processor includes:

a current limiter to calculate the compensating data based on the on-pixel ratio and to calculate a compensation brightness data of the image signal based on the compensating data; and a brightness controller to select one of a plurality of gamma sets and one of a plurality of dimming values based on the compensation brightness data, and wherein:

the compensating data are grayscale data, and the compensation brightness data are luminance data, wherein the current limiter includes a compensation brightness calculator to calculate the compensating brightness data based on the compensating data and an input brightness, and wherein the brightness of the image signal is controlled without remapping or converting the image signal.

9. The display device as claimed in claim 8, wherein the data driver is to generate the data signal corresponding to a data voltage based on the image signal and the selected gamma set.

10. The display device as claimed in claim 8, wherein the emission controller is to generate the emission control signal based on the selected dimming value.

11. The display device as claimed in claim 8, wherein the current limiter further includes:

an on-pixel ratio calculator to calculate the on-pixel ratio of the image signal; and a compensating data calculator to calculate the compensating data corresponding to the on-pixel ratio.

12. The display device as claimed in claim 11, wherein the compensating data calculator is to calculate the compensating data when the on-pixel ratio is higher than a predetermined reference grayscale data level.

13. The display device as claimed in claim 12, wherein the compensating data calculator is to calculate the compensating data based on the reference grayscale data level, a maximum grayscale data level, and a predetermined maximum compensating data.

14. The display device as claimed in claim 11, wherein the on-pixel ratio calculator is to calculate the on-pixel ratio of the image signal based on a red on-pixel ratio of a red image signal in the image signal, a green on-pixel ratio of a green image signal in the image signal, and a blue on-pixel ratio of a blue image signal in the image signal.

15. The display device as claimed in claim 11, wherein the brightness controller is to select one of the gamma sets based on the compensation brightness data.

16. The display device as claimed in claim 11, wherein the brightness controller is to select one of the dimming values based on the compensation brightness data.

17. The display device as claimed in claim 8, wherein the image processor is coupled to or located in the data driver.

* * * * *